US007398958B1

(12) United States Patent
Michel et al.

(10) Patent No.: US 7,398,958 B1
(45) Date of Patent: Jul. 15, 2008

(54) MULTIPLE SHEAVE ASSEMBLY SYSTEM WITH COMPRESSION AND SUPPORT SHEAVES OF AN AERIAL ROPEWAY TRANSPORT INSTALLATION ROPE

(75) Inventors: Daniel Michel, Proveysieux (FR); Laurent Bonifat, La Buisse (FR); Thierry Triolier, Voiron (FR)

(73) Assignee: Pomagalski SA., Fontaine (FR)

( * ) Notice: Subject to any disclaimer, the term of this patent is extended or adjusted under 35 U.S.C. 154(b) by 0 days.

(21) Appl. No.: 11/984,390

(22) Filed: Nov. 16, 2007

(30) Foreign Application Priority Data

Jan. 16, 2007 (FR) ..... 07 00282

(51) Int. Cl.
*B66D 3/08* (2006.01)

(52) U.S. Cl. ..... 254/394; 104/112; 104/173.1; 104/173.2

(58) Field of Classification Search ..... 254/393, 254/394; 104/112, 113, 173.1, 173.2
See application file for complete search history.

(56) References Cited

U.S. PATENT DOCUMENTS 871,431 A * 11/1907 Mozingo ..... 104/177
3,347,172 A * 10/1967 Sowder ..... 104/173.2
4,329,926 A 5/1982 Sowder et al.
4,691,642 A * 9/1987 Creissels ..... 104/173.1
4,957,047 A * 9/1990 Feuz et al. ..... 104/204
6,345,578 B1 2/2002 Pabst

FOREIGN PATENT DOCUMENTS

| | | |
|---|---|---|
| EP | 0 216 340 B1 | 4/1987 |
| FR | 1 524 976 A | 5/1968 |
| FR | 2 106 024 A | 4/1972 |

* cited by examiner

*Primary Examiner*—Emmanuel M Marcelo
(74) *Attorney, Agent, or Firm*—Oliff & Berridge, PLC

(57) ABSTRACT

A range of mixed support and compression sheave assemblies is formed from standard 2S2C modules each comprising:

two compression sheaves (11) and two support sheaves (12) respectively mounted rotating freely on the ends of two pairs of holding arms (15,16; 18,19) articulated on one another by a first upper joint pin (17) and a second lower joint pin (20), a first damping element (24) inserted between two bearing edges (22,23) securedly fixed to the two holding arms (15,16) of the compression sheaves (11), a second damping element (27) inserted between two bearing edges (25,26) of the two holding arms (18,19) of the support sheaves (12), and a frame (28) connecting the first and second joint pins (17,20), said frame being arranged to be connected to the end of a beam (14) with a swivel-pin (21).

7 Claims, 2 Drawing Sheets

MULTIPLE SHEAVE ASSEMBLY SYSTEM WITH COMPRESSION AND SUPPORT SHEAVES OF AN AERIAL ROPEWAY TRANSPORT INSTALLATION ROPE

BACKGROUND OF THE INVENTION

The invention relates to a mixed sheave assembly for support and compression of an aerial carrying-hauling rope of a ski lift, comprising at least one sheave assembly module composed of an upper compression sheave assembly, a lower support sheave assembly, and flexible means acting on the sheave assemblies when the sheaves are moved apart when a grip passes.

STATE OF THE ART

In chair lift or gondola car transport installations, the carrying-hauling rope is guided and held by a plurality of sheaves arranged as support sheave assemblies and compression sheave assemblies supported by pylons placed between the loading and unloading terminals. Chairs or cars are fixed to the rope by fixed or detachable grips. The sheaves are generally associated in pairs and are fitted to the ends of primary sheave assemblies, which are articulated in the middle part on the ends of secondary sheave assemblies, themselves mounted in the same way on tertiary sheave assemblies, and so on depending on the number of sheaves. The last sheave assembly forms a girder mounted articulated in its middle part on a beam of the bearing structure of the pylon. Such an arrangement enables the sheaves to follow the path of the rope with a homogeneous distribution of the load on the sheaves, regardless of the load conditions.

A mixed compression and support sheave assembly described for example in the documents EP 216340 and U.S. Pat. No. 6,345,578 comprises a module equipped at the top part with four compression sheaves and at the bottom part with four support sheaves. The module forms a 4S4C sheave assembly and the rope runs between the four compression sheaves and the four support sheaves when the gondola car or chair grips pass. The four compression sheaves above the rope are fitted two by two at the top part on two auxiliary sheave assemblies subjected to the action of one or two springs. In the same way, the four compression sheaves are fitted two by two at the bottom part on two other auxiliary sheave assemblies subjected to the action of one or two springs. Associating two 4S4C modules mounted on a balancing beam gives an 8S8C assembly that is bulky and heavy. Separation of the sheaves when the grip passes requires large forces to move the sheave assemblies with eight sheaves. This results in vibrations and a certain lack of comfort for the passengers inside the gondola car.

OBJECT OF THE INVENTION

The object of the invention consists in providing a s compression and support heave assembly of modular design enabling vibrations to be reduced and damping the dynamic effects by reducing the weight of the moving masses and the forces involved in moving the sheaves apart when the grip passes.

The device according to the invention is characterized in that each module comprises:

two compression sheaves and two support sheaves respectively mounted rotating freely on the ends of two pairs of holding arms articulated on one another by a first upper joint pin and a second lower joint pin, the two holding arms of the compression sheaves being arranged in a V shape, and the holding arms of the support sheaves being arranged in a reverse V shape, a first damping element inserted between two bearing edges fixedly secured to the two holding arms of the compression sheaves, a second damping element inserted between two bearing edges of the two holding arms of the support sheaves, and a frame connecting the first and second joint pins, said frame being arranged so as to be connected to the end of a beam with a swivel-pin.

The set of four arms form an X with the connecting frame, and the compression sheaves and the support sheaves can have the same diameter or different diameters.

From these standard sheave assembly modules each having two compression sheaves operating in conjunction with two support sheaves, a complete range of multiple sheave assemblies can be created, for example 4S4C, 6S6C, 8S8C, etc. . . . Each module is of standard 2S2C type, i.e. having two support sheaves and two compression sheaves. The weights and forces involved when the grips pass are reduced to enhance user comfort and the dynamic forces induced.

BRIEF DESCRIPTION OF THE DRAWINGS

Other advantages and features will become more clearly apparent from the following description of an embodiment of the invention given as a non-restrictive example only and represented in the accompanying drawings, in which.

DESCRIPTION OF A PREFERRED EMBODIMENT

Figure 1:
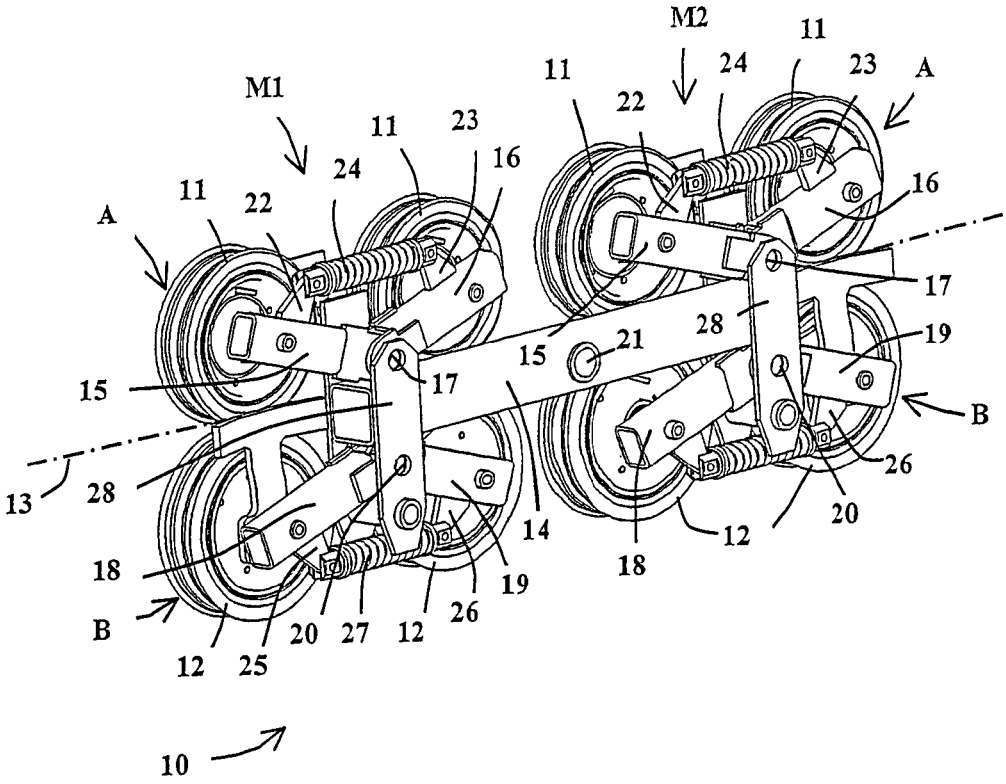
FIG. 1 is a perspective view of a mixed compression and support sheave assembly according to the invention equipped with two elemental modules.
Figure 2:
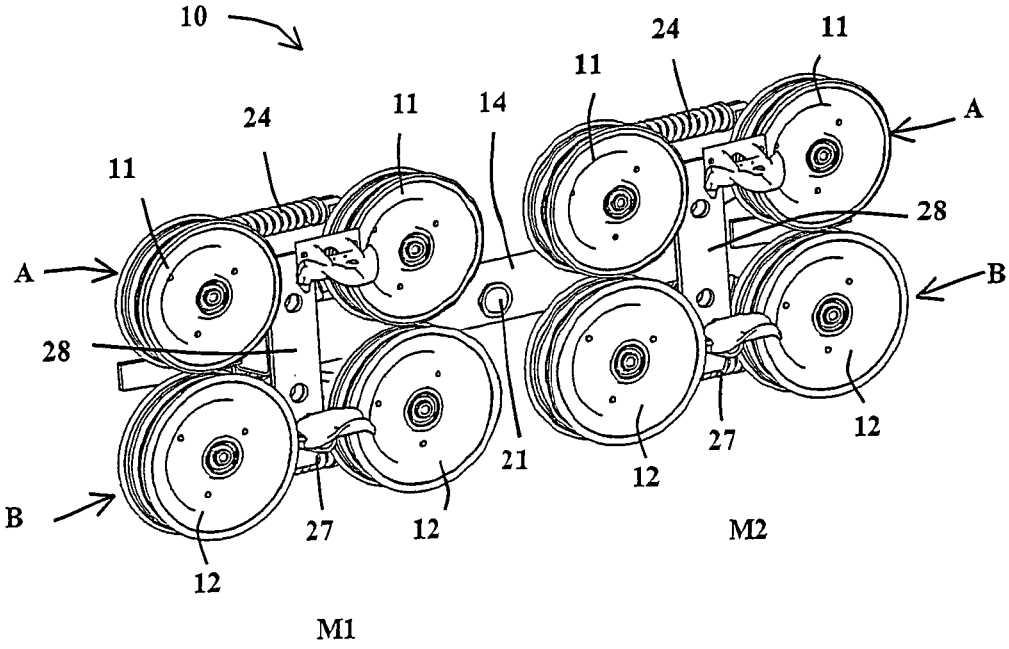
FIG. 2 shows a rear perspective view of the sheave assembly of FIG. 1.

With reference to FIGS. 1 and 2, a mixed sheave assembly 10 with eight compression and support sheaves 11, 12 of an aerial carrying-hauling rope 13 is designed to be mounted on a support structure fixed to a pylori of a ski lift installation, in particular a chair lift or gondola car. The mixed sheave assembly 10 is composed of two identical sheave assembly modules M1, M2 mounted on the opposite ends of a holding beam 14. The rope 13 runs between the compression sheaves 11 and the support sheaves 12 of the two sheave assembly modules M1, M2 arranged along the longitudinal direction of the rope.

Each sheave assembly module M1, M2 comprises:

an upper sheave assembly A with two compression sheaves 11 mounted rotating freely on the ends of two holding arms 15, 16 which are articulated on one another by a first upper joint pin 17;

and a lower sheave assembly B with two support sheaves 12 also mounted rotating freely on the ends of two holding arms 18, 19 which are articulated on one another by a second lower joint pin 20.

The beam 14 is straight and is provided in the central part with a swivel-pin 21 securedly fixed to the bearing structure. According to an alternative embodiment (not shown), the beam 14 can have a curved shape with a predetermined radius of curvature depending on the incoming or outgoing angle of the rope 13.

Each sheave 11, 12 of the different modules M1, M2 presents a groove on its periphery for guiding the rope 13, and is mounted rotating on a pin by means of ball-bearings. The compression sheaves 11 and support sheaves 12 can have the same diameter or different diameters. The two joint pins 17, 20 of the upper and lower sheave assembly elements A, B extend in a parallel direction to the rotation pins of the sheaves 11, 12, and to the swivel-pin 21 of the beam 14.

The articulated holding arms 15, 16 of each upper sheave assembly A comprise bearing edges 22, 23 offset one from the other with respect to the first joint pin 17 so as to define a gap receiving a first damping spring 24. The latter can also be formed by a pad of compressible elastic material, in particular an elastomer-based or rubber-based material.

In similar manner, the articulated holding arms 18, 19 of each lower sheave assembly B comprise bearing edges 25, 26 offset one from the other with respect to the second joint pin 20 so as to define a gap receiving a second damping spring 27.

The two joint pins 17, 20 of the two pairs of holding arms 15, 16; 18, 19 of each sheave assembly module M1, M2 are supported by a connecting frame 28 extending perpendicularly to the beam 14. The frame 28 is composed of two parallel flanges separated by a space for fixing the corresponding end of the beam 14 in the intermediate zone between the two joint pins 17, 20 (see FIG. 1).

The assembly is X-shaped allowing a relative swiveling movement of the holding arms 15, 16; 18, 19 around the respective joint pins 17, 20 when a grip of a chair or a car passes on the rope 13. The damping springs 24, 27 of each sheave assembly module M1, M2 prevent shock waves from forming along the rope 13 and improve the comfort on the line, by dissipating the energy due to the impact of the grip.

The mixed sheave assembly system 10 of FIGS. 1 and 2 with eight compression and support sheaves 11, 12 is formed by means of two identical sheave assembly modules M1, M2 articulated on the ends of a beam 14.

A complete range of multiple sheave assemblies can be created from these standard sheave assembly modules M1, M2 each having two compression sheaves 11 operating in conjunction with two support sheaves 12. Each of these modules is of the 2S2C type, i.e. having two support sheaves and two compression sheaves.

Figure 3:
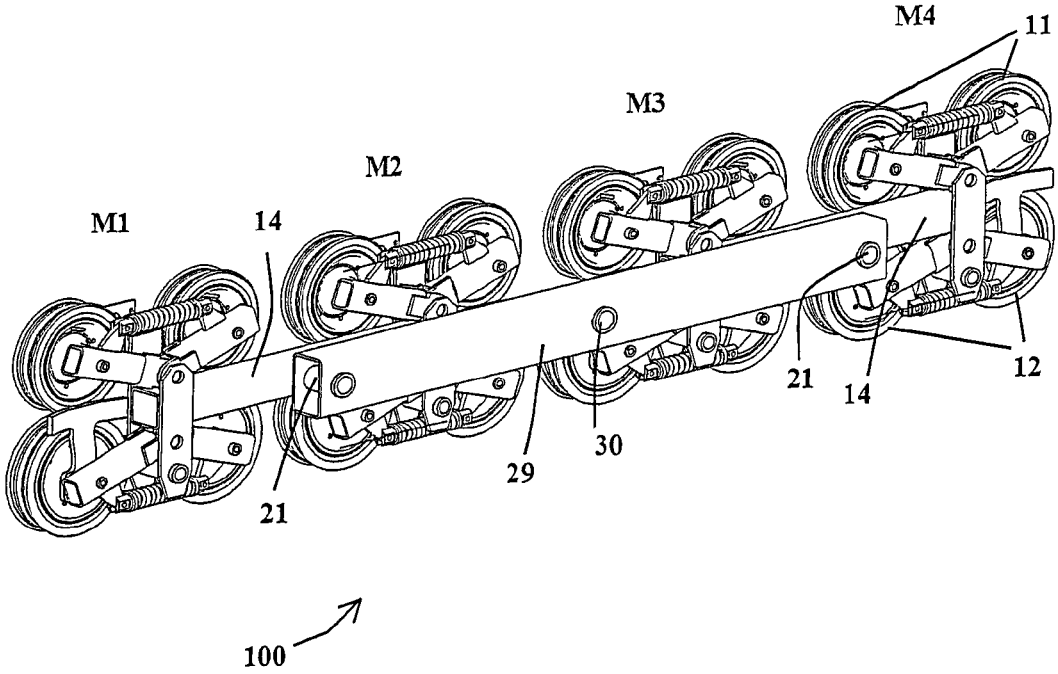
FIG. 3 represents a perspective view of a mixed compression and support sheave assembly according to the invention equipped with four elemental modules.
Figure 4:
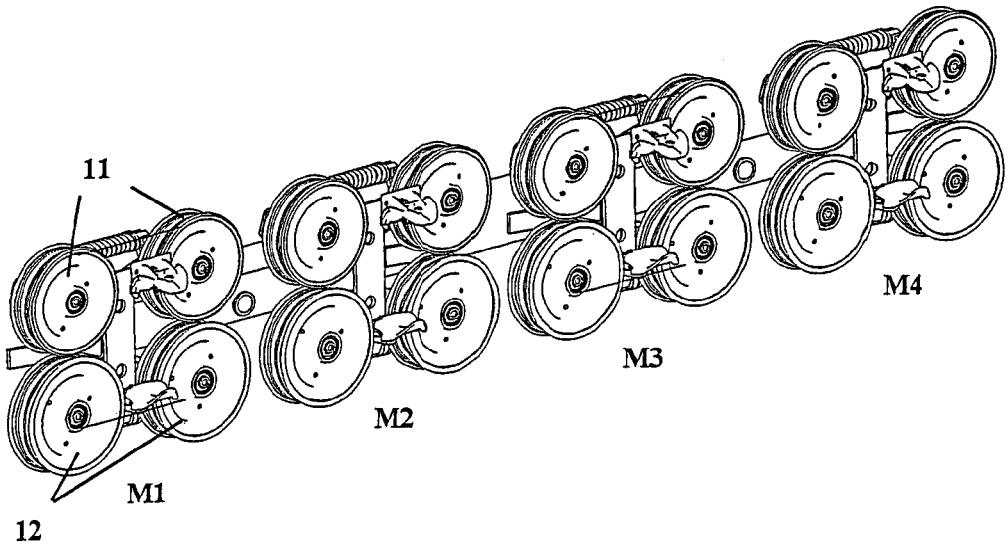
FIG. 4 represents a rear perspective view of the sheave assembly of FIG. 3.

FIGS. 3 and 4 show an example of a sheave assembly system 100 composed of four modules M1, M2, M3, M4 of identical 2S2C structure. The mounting of the first two modules M1, M2 on the associated beam 14 is identical to that of FIGS. 1 and 2. Identical assembly is then performed for the third and fourth modules M3, M4, and the respective swivel-pins 21 of the two elemental beams 14 are supported by the ends of a main sheave assembly 29, which is mounted rotating on a main pin 30 securedly fixed to a pylori.

This results in a reduction of the weight and forces involved when the grips pass, which improves the comfort of the people transported. To limit the vibrations caused by running of the rope, the distance between the sheaves of each module is selected according to the stranding pitch of the rope 13, and will be the same between all the sheaves.

The invention is applicable to compression and support sheave assemblies comprising a different number of elemental modules M1, M2, M3, M4, in particular to a sheave assembly with a single module, or having an odd number of modules.

The first and second springs 24, 27 of the different modules can naturally be replaced by any other flexible damping element.

The invention claimed is:

1. A mixed sheave assembly for support and compression of an aerial carrying-hauling rope of a ski lift, comprising at least one sheave assembly module composed of an upper sheave assembly with compression sheaves, a lower sheave assembly with support sheaves, and flexible means acting on the sheave assemblies when the sheaves are moved apart when a grip passes, wherein each module comprises:

two compression sheaves and two support sheaves respectively mounted rotating freely on the ends of two pairs of holding arms articulated on one another by a first upper joint pin and a second lower joint pin, the two holding arms of the compression sheaves being arranged in a V shape, and the holding arms of the support sheaves being positioned in a reverse V shape, a first damping element inserted between two bearing edges fixedly secured to the two holding arms of the compression sheaves, a second damping element inserted between two bearing edges of the two holding arms of the support sheaves, and a frame connecting the first and second joint pins, said frame being arranged so as to be connected to the end of a beam with a swivel-pin.

2. The mixed sheave assembly according to claim 1, wherein the assembly formed by the holding arms forms an X shape with the connecting frame.

3. The mixed sheave assembly according to claim 1, wherein the connecting frame of each module extends in the vertical mid-plane of the sheaves and perpendicularly to the damping springs.

4. The mixed sheave assembly according to claim 1, wherein the compression sheaves and support sheaves have identical diameters.

5. The mixed sheave assembly according to claim 1, wherein the compression sheaves and support sheaves have different diameters.

6. The mixed sheave assembly according to claim 1, wherein the damping elements of the modules are formed by springs.

7. A modular mixed support and compression sheave assembly comprising an even or odd number of sheave assembly modules according to claim 1.

* * * * *